US010174759B2

(12) United States Patent
Kim

(10) Patent No.: US 10,174,759 B2
(45) Date of Patent: Jan. 8, 2019

(54) DUAL PUMP SYSTEM

(71) Applicant: MYUNGHWA IND. CO., LTD., Seoul (KR)

(72) Inventor: Jin Yong Kim, Gunpo-si (KR)

(73) Assignee: MYUNGHWA IND. CO., LTD., Seoul (KR)

( * ) Notice: Subject to any disclaimer, the term of this patent is extended or adjusted under 35 U.S.C. 154(b) by 183 days.

(21) Appl. No.: 15/259,056

(22) Filed: Sep. 8, 2016

(65) Prior Publication Data

US 2017/0074261 A1 Mar. 16, 2017

(30) Foreign Application Priority Data

Sep. 10, 2015 (KR) ..... 10-2015-0128133

(51) Int. Cl.

| | |
|---|---|
| ***F04C 2/18*** | (2006.01) |
| ***F04C 11/00*** | (2006.01) |
| ***F04C 14/26*** | (2006.01) |
| ***F04C 2/08*** | (2006.01) |
| ***F04C 15/06*** | (2006.01) |

(52) U.S. Cl.

CPC ..... *F04C 11/003* (2013.01); *F04C 2/084* (2013.01); *F04C 2/18* (2013.01); *F04C 14/26* (2013.01); *F04C 15/06* (2013.01); *F04C 2240/30* (2013.01)

(58) Field of Classification Search

CPC ..... F01M 1/16; F02M 59/00; F04C 2220/24; F04C 2270/20; F04C 2/18; Y10T 137/2514; Y10T 137/2516

See application file for complete search history.

(56) References Cited

U.S. PATENT DOCUMENTS

| | | | | |
|---|---|---|---|---|
| 5,547,349 | A * | 8/1996 | Kimura | F01M 1/16 417/282 |
| 8,387,648 | B2 * | 3/2013 | Leskinen | F04C 2/18 137/99 |
| 2006/0171818 | A1 * | 8/2006 | Kato | F01M 1/16 417/302 |
| 2015/0300218 | A1 * | 10/2015 | Taguchi | F01M 1/08 123/196 CP |

FOREIGN PATENT DOCUMENTS

| | | | |
|---|---|---|---|
| KR | 10-1509994 | B1 | 4/2015 |

* cited by examiner

*Primary Examiner* — Patrick Hamo
(74) *Attorney, Agent, or Firm* — Revolution IP, PLLC

(57) ABSTRACT

Provided is a dual pump system including: a dual pump provided with a plurality of chambers independent from each other, wherein an input and an output port are provided in each of the chambers; a plurality of output lines connected to the output ports of the plurality of chambers, respectively; and a switching valve that is provided in an output line of one side of the plurality of output lines, enables a fluid to flow to the output line when operating in one direction, and enables the fluid to be drained to an oil pan through a bypass line branched from the output line when operating in the other direction.

7 Claims, 8 Drawing Sheets

【FIG. 1】
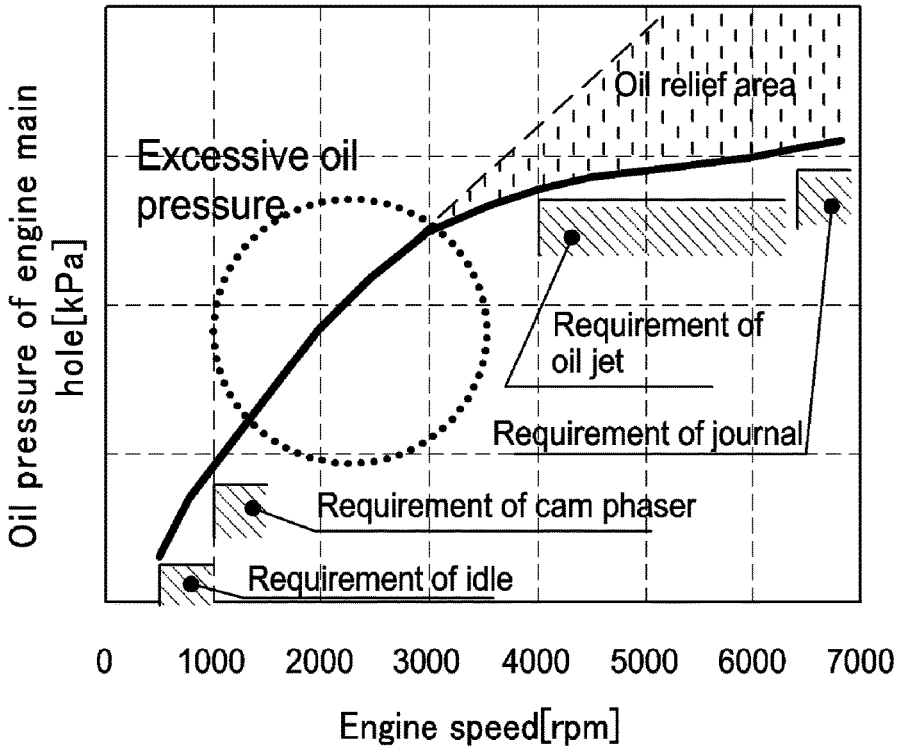

【FIG. 2】
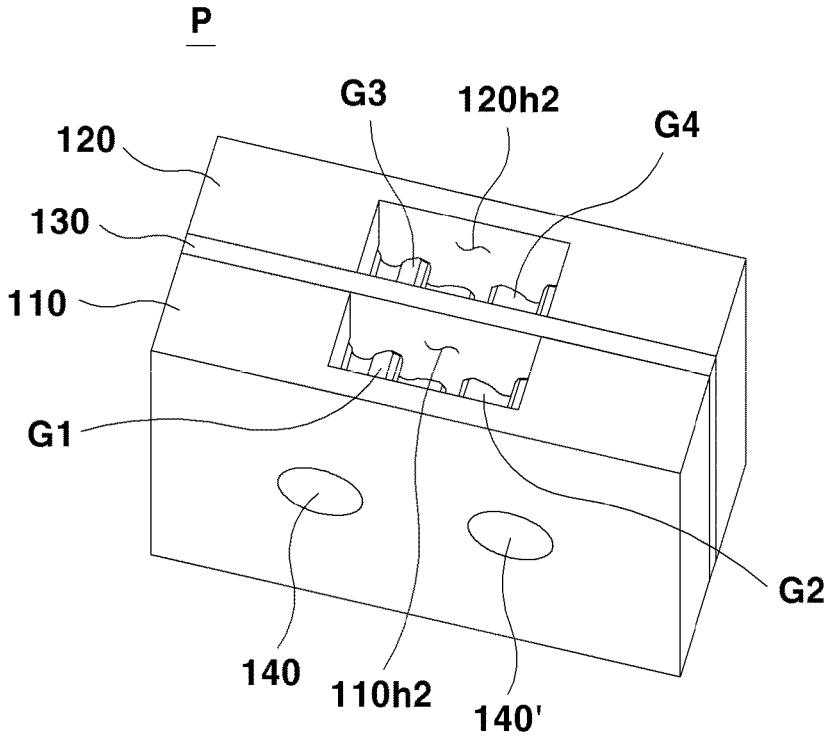

【FIG. 3】
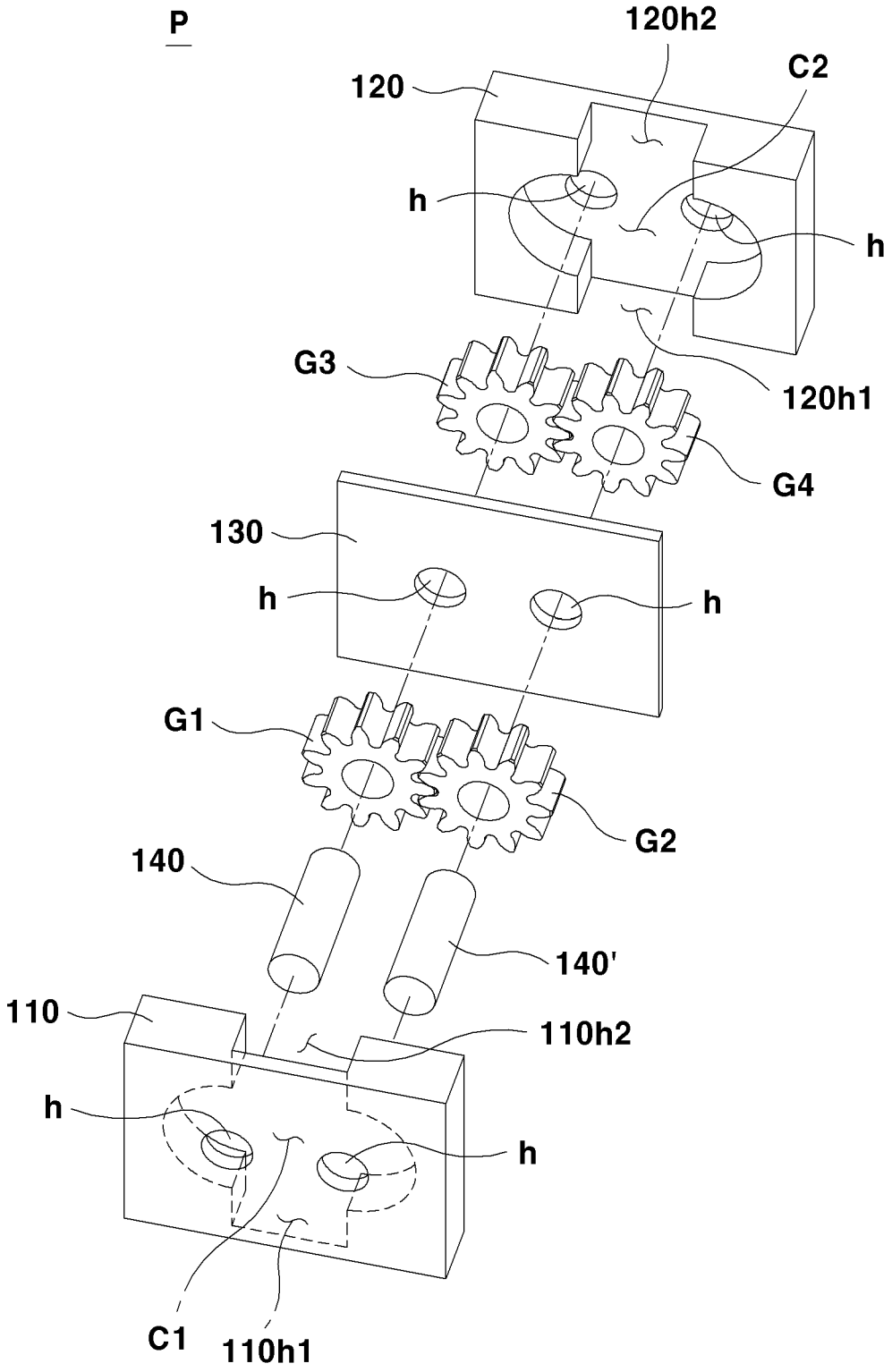

【FIG. 4】
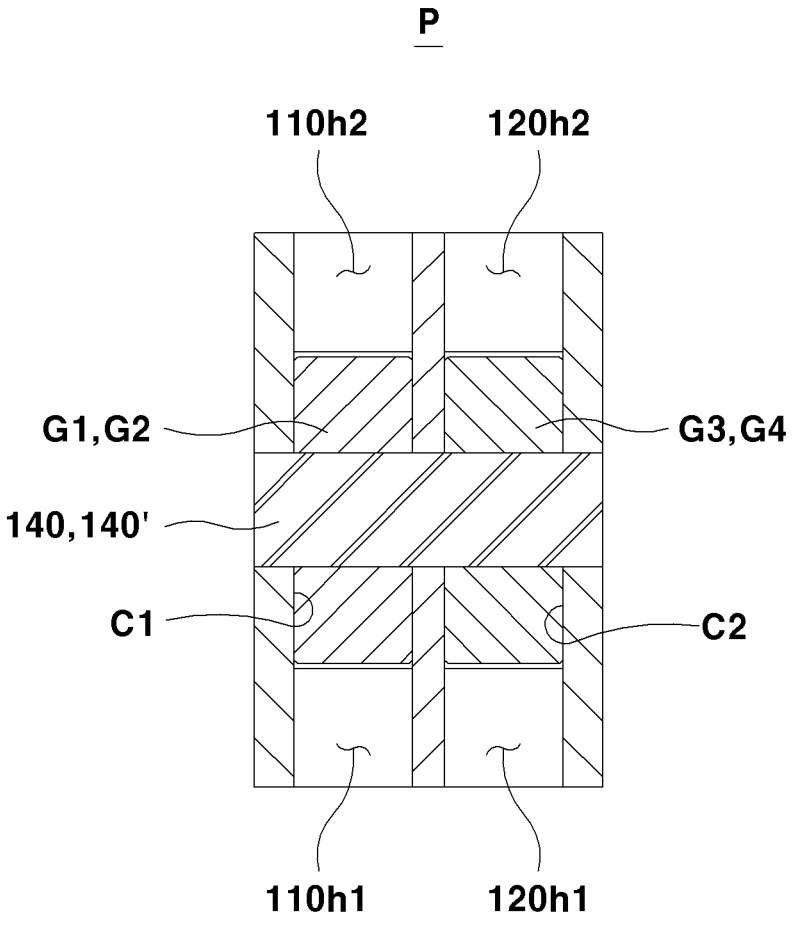

【FIG. 5】
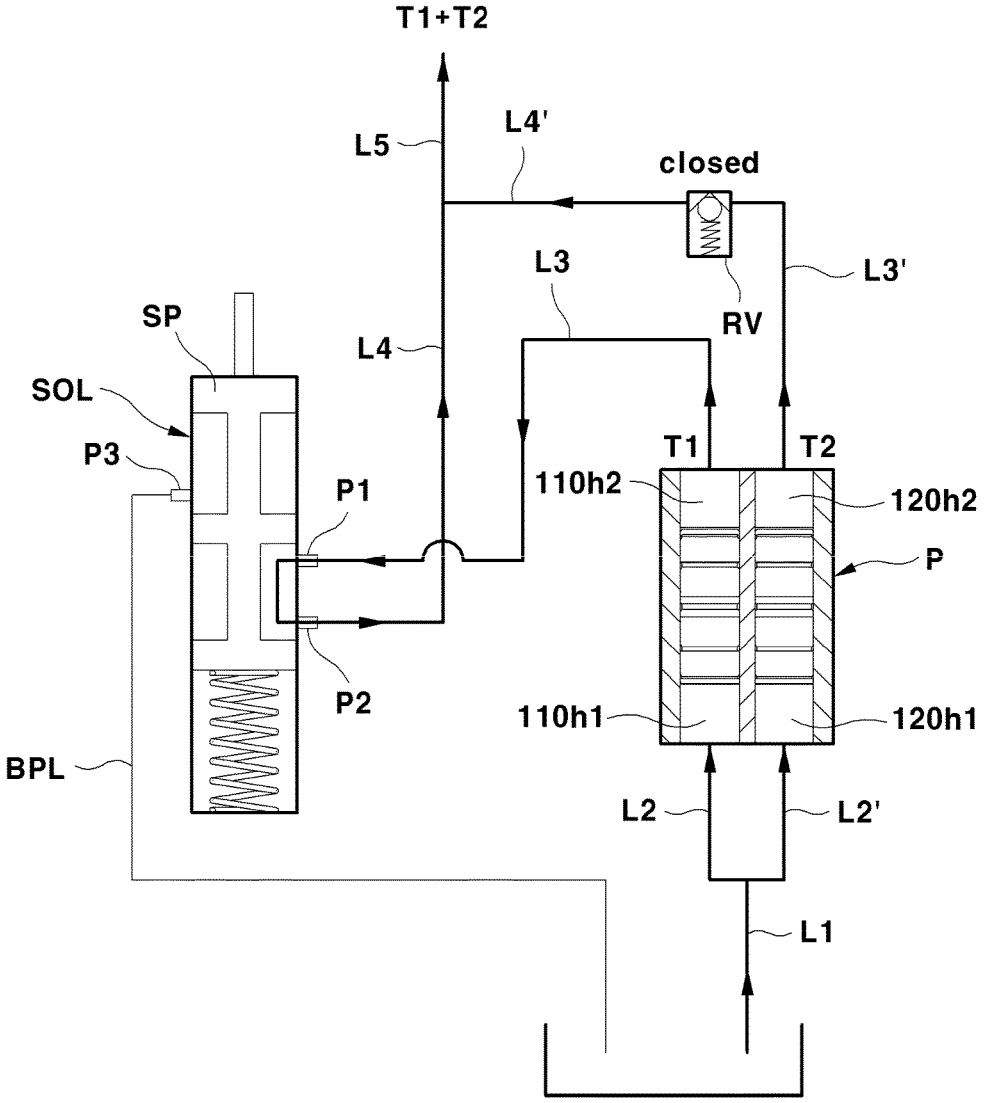

【FIG. 6】
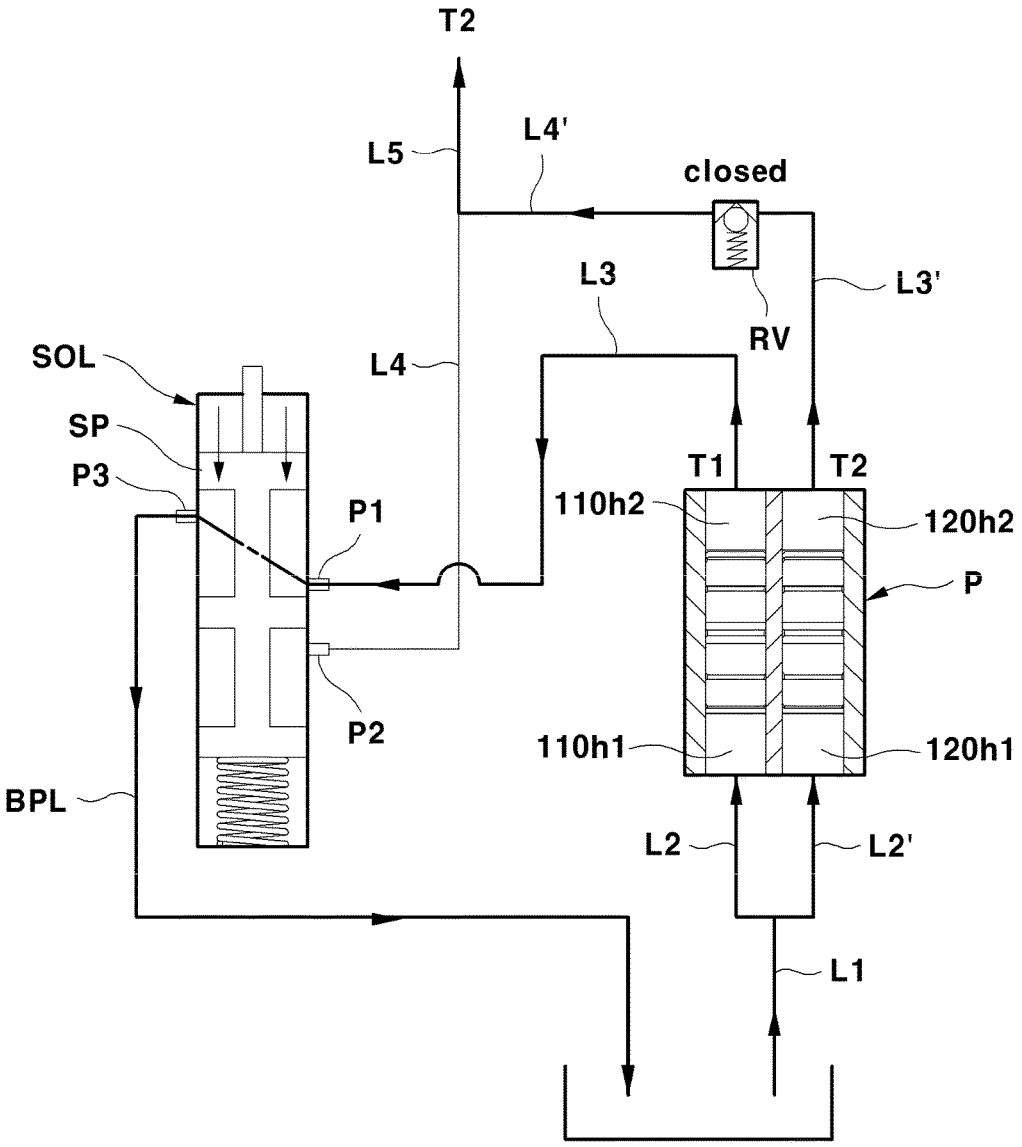

【FIG. 7】
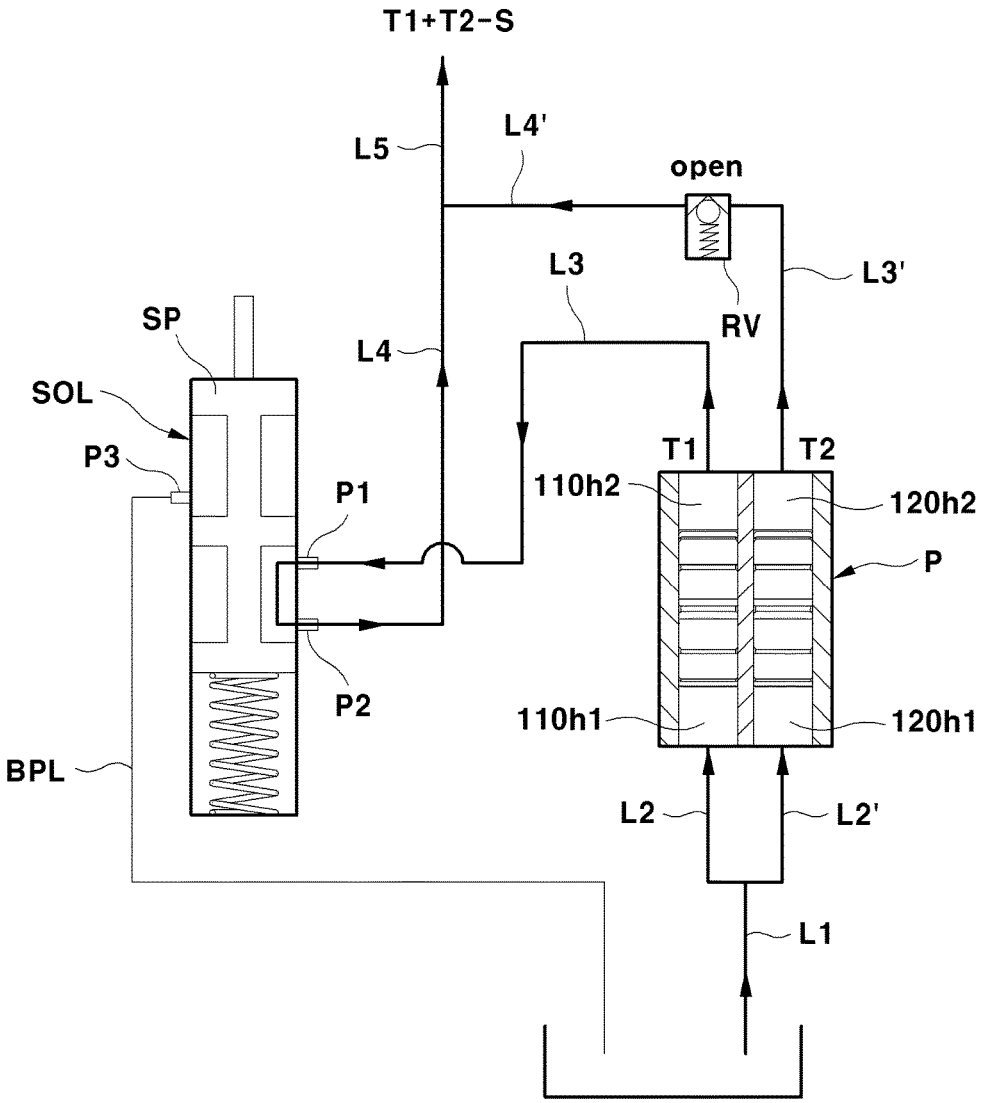

【FIG. 8】
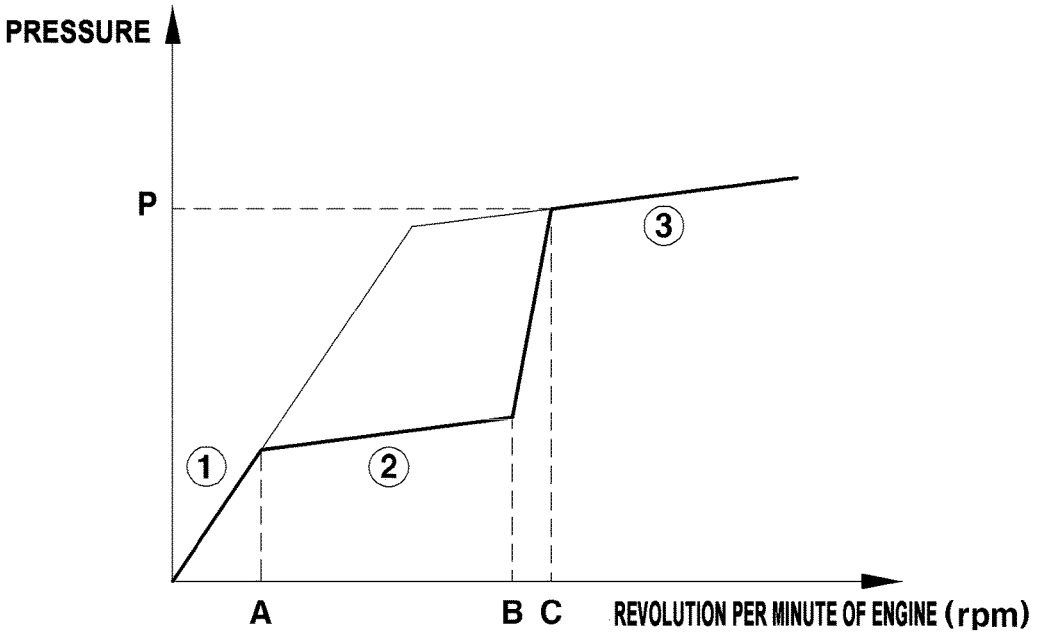

DUAL PUMP SYSTEM

CROSS-REFERENCE TO RELATED APPLICATIONS

This U.S. non-provisional patent application claims priority under 35 U.S.C. § 119 of Korean Patent Application No. 10-2015-0128133, Sep. 10, 2016, the entire contents of which are hereby incorporated by reference.

BACKGROUND

The present invention relates to a dual pump system, and more particularly, to a dual pump system which is capable of bypassing a portion of oil, when the oil supplied to an engine excessively increases in supply pressure, to always maintain an adequate oil supply pressure at each portion of the engine.

Generally, engine oil is circulated through an engine of a vehicle to prevent the engine from being overheated or reduce frictional force between various mechanisms. For this, an oil pump is applied.

However, driving torque of the engine may be lost when the oil pump operates because the oil pump discharges oil to a discharge-side, and simultaneously, operates to suction oil that is retuned to a suction-side.

In vehicles, since the improvement in the driving torque of the engine is essential to improve fuel efficiency, the driving torque loss (power consumption consumed for supplying oil) due to an oil pump, which is proportional to the relationship of "flow rate×hydraulic pressure", may be reduced by improving performance of the oil pump.

In recent years, the importance in fuel reduction of the vehicles is further emphasized by high oil prices and the regulation of carbon dioxide, and thus the improvement of the fuel efficiency and the eco-friendliness are being considered to key factors when the vehicles are developed.

Particularly, when considering the fact in which the improvement of the driving torque of the engine is essential, the reduction of the driving torque through the oil pump may be very effective to improve the fuel efficiency.

For example, as illustrated in FIG. 1, a structure, in which a portion of oil is bypassed through a relief valve at a high speed RPM to reduce an oil pressure and improve fuel efficiency, is disclosed.

The oil pump as described above may reduce the oil pressure in the high speed section. However, since the oil pressure is maintained to a high level as ever in a middle speed section, the improvement of the fuel efficiency may deteriorate.

PRIOR ART DOCUMENT

Patent Registration No. 10-1509994 (Registration date: Apr. 01, 2015)

SUMMARY

To solve the problem according to the related art, an object of the present invention is to provide a dual pump system, which is capable of bypassing a portion of oil when the oil supplied to an engine excessively increases in supply pressure to always maintain an adequate oil supply pressure at each portion of the engine.

A dual pump system of the present invention to solve a technical problem described above includes: a dual pump provided with a plurality of chambers independent from each other, wherein an input port and an output port are provided in each of the chambers; a plurality of output lines connected to the output ports of the plurality of chambers, respectively; and a switching valve that is provided in an output line of one side of the plurality of output lines, enables a fluid to flow to the output line when operating in one direction, and enables the fluid to be drained to an oil pan through a bypass line branched from the output line when operating in the other direction.

The switching valve may operate in the other direction at a first RPM point and operate in the one direction at a second RPM point, wherein an RPM at the second PRM point is greater than that at the first RPM point.

The dual pump system may further include a relief valve disposed in an output line of the other side of the plurality of output lines to drain the fluid when a pressure is greater than a predetermined pressure.

The switching valve may operate in the other direction at a first RPM point and operate in the one direction at a second RPM point, and a relief valve may be provided in an output line of the other side of the plurality of output lines to drain the fluid when a pressure is greater than a predetermined pressure, wherein the first RPM point A, the second RPM point B, and a RPM point C at which the relief valve drains the fluid satisfy the following relationship: $A<B<C$.

The plurality of output lines may be combined with each other to form one line, thereby discharging the fluid.

The dual pump may include: a housing defining the plurality of chambers independent from each other; first and second gears provided in one side chamber of the plurality of chambers and engaged with each other to forcibly feed the fluid introduced to the input port toward the output port; and third and fourth gears in the other side chamber of the plurality of chambers and engaged with each other to forcibly feed the fluid introduced to the input port toward the output port.

One gear in the one side chamber may be interlocked with one gear in the other side chamber by using one shaft, and the other gear in the one side chamber may be interlocked with the other gear in the other side chamber by using one shaft.

The chambers of the dual pump may have pumping capacities different from each other.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings:

FIG. 1 is a graph illustrating a variation in pressure depending on an operation of a pump system according to the related art;

FIG. 2 is a schematic perspective view of a dual gear pump according to an embodiment of the present invention;

FIG. 3 is a schematic exploded perspective view of the dual gear pump according to an embodiment of the present invention;

FIG. 4 is a schematic cross-sectional view of the dual gear pump according to an embodiment of the present invention;

FIG. 5 is a schematic view illustrating an operation in a low speed section of the pump system provided with the dual gear pump according to an embodiment of the present invention;

FIG. 6 is a schematic view illustrating an operation in a middle speed section of the pump system provided with the dual gear pump according to an embodiment of the present invention;

FIG. 7 is a schematic view illustrating an operation during a high speed section of the pump system provided with the dual gear pump according to an embodiment of the present invention; and FIG. 8 is a graph illustrating a variation in pressure depending on an operation of the pump system provided with the dual gear pump according to an embodiment of the present invention.

DETAILED DESCRIPTION

The present invention may be realized in other various forms without departing from the technical idea and the essential feature. Thus, the embodiments of the present invention may be merely illustrative in all aspects, and should not be construed as limited thereto.

It will be understood that although the terms of first and second are used herein to describe various elements, these elements should not be limited by these terms.

The terms are only used to distinguish one element from other elements. For example, a first element can be referred to as a second element, and similarly a second element can be referred to as a first element without departing from the scope of the present invention.

The term 'and/or' includes a combination of a plurality of items relevantly described or any one of a plurality of terms relevantly described.

It will also be understood that when an element is referred to as being "connected to" or "engaged with" another element, it can be directly connected to the other element, or intervening elements may also be present.

On the other hand, it will be understood that when an element is referred to as being "directly connected to" of "directly engaged with" another element, there is no intervening elements.

In the following description, the terms are used only for explaining a specific exemplary embodiment and not tend to limit the present invention. The terms of a singular form may include plural forms unless definitely referred to the contrary in terms of the context.

In the present application, it will be understood that the meaning of 'include', 'comprise', or 'have' specifies the presence of a feature, a fixed number, a step, a process, an element, a component, or a combination thereof disclosed in the specification, but does not exclude the presence or addition of one or more other features, fixed numbers, steps, processes, elements, components, or combinations thereof.

Unless otherwise defined, all terms (including technical and scientific terms) used herein have the same meaning as generally understood by those skilled in the art.

Terms as defined in a commonly used dictionary should be construed as having the same meaning as in an associated technical context, and unless defined apparently in the description, the terms are not ideally or excessively construed as having formal meaning.

Hereinafter, preferred embodiment according to the present invention is described with reference to the accompanying drawings, and the same or corresponding elements are given with the same drawing number regardless of reference number, and their duplicated description will be omitted.

In the following description, if a detailed description related to well-known technology is determined to obscure subject matters of the present invention, the detailed description may be omitted.

A pump system according to an embodiment of the present invention includes a dual pump P as illustrated in FIGS. 2 to 4.

The dual pump P is provided with a plurality of chambers C1 and C2 that are independent from each other, and each of the chambers C1 and C2 is provided with input ports 110h1 and 120h1 and output ports 110h2 and 120h2.

The pump system includes a plurality of output lines L3, L3', L4, and L4' respectively connected to the output ports 110h2 and 120h2 of the plurality of chambers C1 and C2 and a switching valve SOL which is provided in the output lines L3 and L4 of one side of the plurality of output lines L3, L3', L4, and L4'. The switching valve SOL enables fluid to flow toward the output lines L3 and L4 when operating in one direction and enables the fluid to be drained toward an oil pan through a bypass line BPL branched from the output lines L3 and L4 when operating in the other direction.

First, a constitution of the dual pump P will be described.

As illustrated in FIG. 3, the dual pump P may include a housing that defines the plurality of chambers C1 and C2 independent from each other. The housing includes one side housing 110, the other side housing 120, and a wall 130 disposed between the one side housing 110 and the other side housing 120.

The one side housing 110 defines the one side chamber C1, and a first input port 110h1 and a first output port 110h2 are disposed in the one side housing 110. The other side housing 120 defines the other side chamber C2, and a second input port 120h1 and a second output port 120h2 are disposed in the other side housing 120.

Also, first and second gears G1 and G2, which are engaged with each other to forcibly feed the fluid introduced to the first input port 110h1 toward the first output port 110h2, are built in the one side housing 110. Third and fourth gears G3 and G4, which are engaged with each other to forcibly feed the fluid introduced to the second input port 120h1 toward the second output port 120h2, are built in the other side housing 120.

The first and third gears G1 and G3 are shaft-coupled to a first shaft 140 passing through the one side housing 110 and the other side housing 120 to rotate, and the second and fourth gears G2 and G4 are shaft-coupled to a second shaft 140' passing through the one side housing 110 and the other side housing 120 to rotate. As one of the first shaft 140 and the second shaft 140' is connected to a driving motor (not shown) to rotate, all the first to fourth gears G1, G2, G3, and G4 may be interlocked with each other to be rotationally driven.

The dual pump P as described above may have pumping capacities different from ach other in the one side chamber C1 defined by the one side housing 110 and the other side chamber C2 defined by the other side housing 120. For this, an inner space of the one side housing 110 may have a volume different from that of an inner space of the other side housing 120.

Also, configuration conditions such as thicknesses and the number of gear teeth in the first and second gears G1 and G2 and the third and fourth gears G3 and G4 are appropriately designed and modified so that the pumping capacities of the one side chamber C1 and the other side chamber C2 are selectively changed and applied. That is, the pumping capacities may be adjustable through a simple manner in which the configuration conditions of the gears are modified.

Next, the pumping system provided with the dual pump P as set forth will be described.

As described above, the pump system includes the dual pump P, the plurality of output lines L3, L3', L4, and L4', and the switching valve SOL as illustrated in FIGS. 5 to 7.

Particularly, the pump system according to an embodiment includes a first introduction line L1 through which a fluid in an oil pan is introduced, a second introduction line L2 through which the fluid is introduced from the first introduction line L1 to the first input port 110h1, a second' introduction line L2' through which the fluid is introduced from the first introduction line L1 to the second input port 120h1, the first output line L3 through which the fluid is introduced from the first output port 110h2 to an input port P1 of the switching valve SOL, the first' output line L3' through which the fluid is introduced from the second output port 120h2 to a relief valve RV, a second output line L4 through which the fluid introduced to the input port P1 of the switching valve SOL is introduced to a final output line L5, a second∝ output line L4' through which the fluid passing through the relief valve RV is introduced to the final output line L5, and a bypass line BPL that drains the fluid introduced to the input port P1 of the relief valve RV to the oil pan.

The switching valve SOL is disposed between the first output line L3 and the second output line L4 to perform a switching operation so that, when a spool SP in the switching valve SOL operates in one direction, the fluid introduced to the input port P1 is output to an output port P2 to flow to the second output line L4, and when the spool SP operates in the other direction, the fluid introduced to the input port P1 is output to an output port P3 to flow to the bypass line BPL.

The relief valve RV is disposed between the first' output line L3' and the second' output line L4'. The relief valve RV is opened at a predetermined pressure or more to drain a portion of the fluid introduced to the first' output line L3' to the oil pan.

Particularly, in the switching valve SOL, the spool SP operates in the other direction at a first RPM point of the engine A and operates in the one direction at a second RPM point of the engine B. When comparing an RPM point C at which the relief valve RV drains the fluid to the first and second RPM points, a relationship of an inequality expressed by A<B<C may be satisfied.

Next, the pumping system provided with the dual pump P as described above will be described with respect to each of operations of a low speed, a middle speed, and a high speed.

<Low speed section: an engine RPM is less than the first PPM point A>

As illustrated in FIG. 5, the switching valve SOL operates in the one direction in the low speed section, and thus, the fluid introduced to the input port P1 of the switching valve SOL flows to the second output line L4.

Here, the relief valve RV does not operate to be opened because the oil pressure is less than the predetermined pressure P.

Thus, a pressure of oil outputted to the final output line L5 is determined as a pressure T1+T2 that is obtained by adding a pressure T1 of oil outputted through the second output line L4 and a pressure T2 of oil outputted through the second' output line L4'. The pressure significantly increases in a shape of a graph corresponding to a section ① of FIG. 8.

<Middle speed section: an engine RPM is ranging from the first RPM point A to the second PPM point B>

As illustrated in FIG. 6, the switching valve SOL operates in the other direction in the middle speed section, and thus, the fluid introduced to the input port P1 of the switching valve SOL flows to the bypassing line BPL.

Here, the relief valve RV does not operate to be opened because the oil pressure is less than the predetermined pressure P.

Thus, a pressure of oil outputted to the final output line L5 is determined as a pressure T2 of oil outputted through the second' output line L4'. The pressure moderately increases in a shape of a graph corresponding to section ② of FIG. 8.

<High speed section: an engine RPM is greater than the second PPM point B>

As illustrated in FIG. 7, the switching valve SOL operates in the one direction in the high speed section, and thus, the fluid introduced to the input port P1 of the switching valve SOL flows to the second output line L4.

Also, the relief valve RV does not operate to be opened in an initial state in which the engine RPM exceeds the second PRM B because the oil pressure is less than the predetermined pressure P. However, when the oil pressure reaches the predetermined pressure as the engine RPM gradually increases, the relief valve RV operates to be opened.

Thus, before the oil pressure reaches the predetermined pressure P1, a pressure of the oil outputted to the final output line L5 is determined as a pressure T1+T2 that is obtained by adding a pressure T1 of the oil outputted through the second output line L4 and a pressure T2 of the oil outputted through the second' output line L4'. Also, after the oil pressure reaches the predetermined pressure, a pressure of the oil outputted to the final output line L5 is determined as a pressure T1+T2−S that is decompressed through the relief valve RV from the pressure (T1+T2) obtained by adding the pressure Ti of oil outputted through the second output line L4 and the pressure T2 of oil outputted through the second' output line L4'. The pressure moderately increases in a shape of a graph corresponding to section ③ of FIG. 8.

As described above, the present invention may have the advantage in which, when the supply pressure of the oil supplied to the engine excessively increases, the portion of the oil may be bypassed to always maintain the adequate oil supply pressure at each portion of the engine.

Particularly, the excessive oil supply pressure may be reduced in the middle speed section to reduce the pumping torque in the middle speed section, thereby improving the fuel efficiency.

Also, the fluid within each chamber is discharged through each of the pair of gears of the plurality of chambers. Therefore, the gear may be changed in configuration condition to increase the degree of freedom in selecting the pumping capacity and to achieve the common use of the gear specification.

Also, the driving gear and the driven gear may be provided as the same gear to stabilize the pulsation pressure when the oil is discharged.

Although the present invention has been described with reference to the accompanying drawings with respect to preferred embodiments, it should be understood that various and obvious modifications can be made from this disclosure without departing from the scope of the present invention by those skilled in the art. Hence, the scope of the present invention has to be analyzed by the appended claims to include such modifications.

What is claimed is:

1. A dual pump system for an automobile engine, comprising:

a dual pump provided with a plurality of chambers independent from each other, wherein an input port and an output port are provided in each of the chambers;

a plurality of output lines connected to the output ports of the plurality of chambers, respectively; and a switching valve that is provided in one of the plurality of output lines, enables a fluid to flow to the output line when operating in one direction, and enables the fluid to be drained to an oil pan through a bypass line branched from the one of the plurality of output lines when operating in the other direction, wherein the switching valve is configured to operate in the other direction at a first RPM (revolutions per minute) point and operate in the one direction at a second RPM point, an RPM of the engine at the second PRM point being greater than that at the first RPM point, the switching valve being configured to operate in the one direction when the RPM is less than the first RPM point, the switching valve being configured to operate in the other direction when the RPM ranges between the first RPM point and the second RPM point, the switching valve being configured to operate in the one direction when the RPM is greater than the second RPM point.

2. The dual pump system of claim 1, further comprising a relief valve disposed in the other one of the plurality of output lines to drain the fluid when a pressure is greater than a predetermined pressure.

3. The dual pump system of claim 2, wherein the relief valve drains the fluid when the RPM is greater than the first and the second RPM points and the second RPM point is greater than the first RPM point.

4. The dual pump system of claim 1, wherein the plurality of output lines are combined with each other to form one line, thereby discharging the fluid.

5. The dual pump system of claim 1, wherein the dual pump comprises:

a housing defining the plurality of chambers independent from each other;

first and second gears provided in a first chamber of the plurality of chambers and engaged with each other to forcibly feed the fluid introduced to the input port toward the output port; and third and fourth gears in a second chamber of the plurality of chambers and engaged with each other to forcibly feed the fluid introduced to the input port toward the output port.

6. The dual pump system of claim 5, wherein one gear in the first chamber is interlocked with one gear in the second chamber by using one shaft, and the other gear in the first chamber is interlocked with the other gear in the second chamber by using one shaft.

7. The dual pump system of claim 1, wherein the chambers of the dual pump have pumping capacities different from each other.

* * * * *